US011673246B2

(12) United States Patent
Gerold

(10) Patent No.: US 11,673,246 B2
(45) Date of Patent: Jun. 13, 2023

(54) FLAT CHISEL

(71) Applicant: Hilti Aktiengesellschaft, Schaan (LI)

(72) Inventor: Peter Gerold, Weilheim (DE)

(73) Assignee: Hilti Aktiengesellschaft, Schaan (LI)

( * ) Notice: Subject to any disclaimer, the term of this patent is extended or adjusted under 35 U.S.C. 154(b) by 914 days.

(21) Appl. No.: 16/322,189

(22) PCT Filed: Jul. 31, 2017

(86) PCT No.: PCT/EP2017/069297
§ 371 (c)(1),
(2) Date: Jan. 31, 2019

(87) PCT Pub. No.: WO2018/024666
PCT Pub. Date: Feb. 8, 2018

(65) Prior Publication Data

US 2019/0184539 A1 Jun. 20, 2019

(30) Foreign Application Priority Data

Aug. 2, 2016 (EP) ..... 16182279

(51) Int. Cl.
*B25D 17/02* (2006.01)
*B28D 1/26* (2006.01)
*E21B 10/36* (2006.01)

(52) U.S. Cl.
CPC ..... *B25D 17/02* (2013.01); *B28D 1/26* (2013.01); *E21B 10/36* (2013.01); *B25D 2222/42* (2013.01); *B25D 2222/72* (2013.01)

(58) Field of Classification Search
CPC ..... B25D 2222/42; B25D 2222/72; B25D 17/02; B28D 1/265; B28D 1/26;
(Continued)

(56) References Cited

U.S. PATENT DOCUMENTS 1,098,795 A * 6/1914 Gill ..... E21B 10/36 175/414
1,471,062 A * 10/1923 Riblett ..... B25B 27/00 72/464
(Continued)

FOREIGN PATENT DOCUMENTS

CN 2050069 U 12/1989
CN 2645859 Y 10/2004
(Continued)

OTHER PUBLICATIONS

International Search Report of PCT/EP2017/069297, dated Oct. 13, 2017.
(Continued)

*Primary Examiner* — Abby J Flynn
*Assistant Examiner* — Michael A Goodwin
(74) *Attorney, Agent, or Firm* — Davidson, Davidson & Kappel, LLC

(57) ABSTRACT

A flat chisel (1) having a longitudinal axis (7), a shank (2) and a blade-shaped working section (5). The shank (2) has a striking surface (4) perpendicular to the longitudinal axis (7). The working section (5) has a cutting edge (3) that is crosswise to the longitudinal axis (7). The cutting edge (3) is configured so as to be saddle-shaped.

14 Claims, 4 Drawing Sheets

(58) Field of Classification Search
CPC .... E01C 23/0926; E01C 23/124; E21B 10/36; E21B 10/40
USPC ..... 299/100
See application file for complete search history.

(56) References Cited

U.S. PATENT DOCUMENTS

| | | | | | |
|---|---|---|---|---|---|
| 2,109,390 | A * | 2/1938 | Hokanson | E21B 10/36 | 175/417 |
| 2,900,178 | A | 8/1959 | Harrison et al. | | |
| 3,191,909 | A * | 6/1965 | Reischl | B25D 3/00 | 254/104 |
| 4,083,111 | A * | 4/1978 | Kerins | B23C 1/20 | 30/168 |
| 4,380,492 | A * | 4/1983 | Gut | C25C 3/14 | 205/372 |
| 7,178,878 | B2 | 2/2007 | Rompel et al. | | |
| 2003/0221685 | A1 * | 12/2003 | Lang | B25D 17/02 | 125/41 |

FOREIGN PATENT DOCUMENTS

| | | | | |
|---|---|---|---|---|
| CN | 1721139 | A | 1/2006 | |
| DE | 118286 | | 11/1898 | |
| DE | 20010451 | U1 | 10/2001 | |
| DE | 10100405 | A1 * | 7/2002 | B25D 1/00 |
| EP | 0025418 | | 3/1981 | |
| EP | 1340595 | | 9/2003 | |
| FR | 1036343 | | 9/1953 | |
| FR | 1152841 | | 2/1958 | |

OTHER PUBLICATIONS

Basic Knowledge of woodworking, DeXiang, DEng, p. 112 to 113, *China Railway Press*, Oct. 1984, see machine translation.

* cited by examiner

FLAT CHISEL

FIELD OF THE INVENTION

The present invention relates to a flat chisel to process mineral materials, especially steel-reinforced concrete.

U.S. Pat. No. 2,900,178 A discloses a flat chisel. The flat chisel has a shank and a blade-shaped working section. A cutting edge of the working section is configured so as to have such a convex-chevron shape that there is a tip on the longitudinal axis. The design of the flat chisel promotes a high demolition capacity since the introduced striking force is introduced into the substrate centrally along the longitudinal axis via the tip. The flat chisel, however, is not as well suited for the demolition of steel-reinforced concrete.

DISCLOSURE OF THE INVENTION

The present invention provides a flat chisel that has a longitudinal axis, a shank and a blade-shaped working section. The shank has a striking surface perpendicular to the longitudinal axis. The working section has a cutting edge that is crosswise to the longitudinal axis. The cutting edge is configured so as to be saddle-shaped.

The cutting edge can be positioned on reinforcement steel in order to cut it. The saddle-shaped cutting edge prevents the cutting edge from slipping off of the reinforcement steel. The saddle-shaped design retains its concave shape, even when the cutting edge is at an advanced stage of wear.

The saddle-shaped cutting edge preferably has a first concave curvature in a first plane formed between the longitudinal axis and the transverse axis, and the cutting edge has a second concave curvature in a second plane that is parallel to the longitudinal axis and perpendicular to the transverse axis. The first concave curvature and the second concave curvature can coincide along the transverse axis.

One embodiment provides for the saddle-shaped cutting edge to be arranged symmetrically relative to the longitudinal axis. The first curvature and the second curvature can be on the longitudinal axis.

One embodiment provides for the saddle-shaped cutting edge to be arranged along the transverse axis so as to be offset relative to the longitudinal axis. The first curvature and the second curvature can be arranged along the transverse axis so as to be offset relative to the longitudinal axis.

One embodiment provides for the cutting edge to have a main blade and a saddle-shaped secondary blade, whereby the saddle-shaped secondary blade is formed on the blade-shaped working section by a tooth that is offset relative to the main blade along the longitudinal axis.

One embodiment provides for the cutting edge to have a main blade and a saddle-shaped secondary blade, whereby the saddle-shaped secondary blade is formed in the blade-shaped working section by a recess that is offset relative to the main blade along the longitudinal axis.

BRIEF DESCRIPTION OF THE DRAWINGS

The description below explains the invention on the basis of embodiments and figures provided by way of an example. The figures show the following.

DETAILED DESCRIPTION

Figure 1:
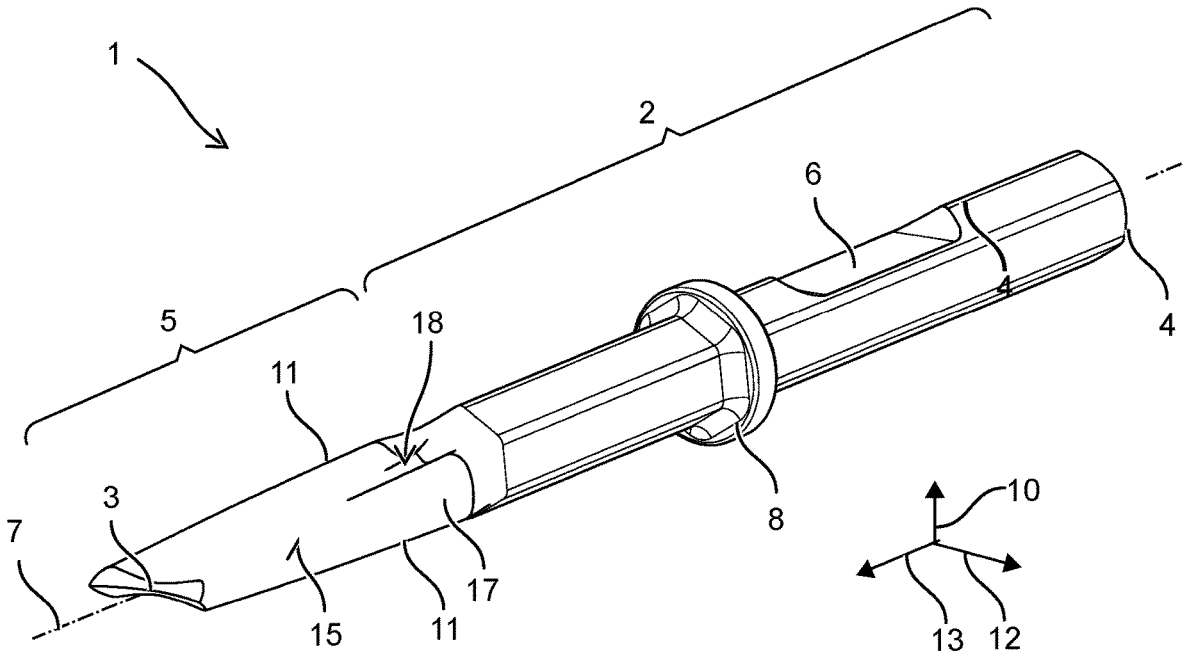
FIG. 1: a flat chisel.

Unless otherwise indicated, identical or functionally equivalent elements are designated in the figures by the same reference numerals.

Embodiments of the Invention

FIG. 1 shows a flat chisel 1 by way of an example. The user can insert the flat chisel 1 via its shank 2 into an electric rotary hammer. A cutting edge 3 of the flat chisel 1 is pressed against the substrate. The striking mechanism of the electric rotary hammer strikes a striking surface 4 on the shank 2. The shock wave of the impact passes through the shank 2 and a working section 5 of the flat chisel 1, thereby driving the cutting edge 3 into the substrate.

The shank 2 of the flat chisel 1 shown by way of an example is configured so as to be prismatic with a hexagonal cross section. As an alternative, the shank 2 can have a circular cross section. The striking surface 4 forms the end face of the shank 2 that is exposed and that faces away from the cutting edge 3. The striking surface 4 can be configured so as to be dome-shaped.

The shank 2 shown by way of an example has a groove 6 that is closed along the longitudinal axis 7. The shank 2 can be inserted into a tool socket of the electric rotary hammer. A locking means, for example, a pawl or a ball, engages into the groove 6 and secures the flat chisel 1 in the tool socket. The shank 2 shown by way of an example has an annular collar 8 that projects radially beyond the shank 2. Other tool sockets lock the flat chisel 1 by means of a pivotable bracket that extends behind the collar 8 on the side of the cutting edge 3. The shank 2 can have the groove 6 as well as the collar 8 or else only one of these two locking means.

The working section 5 is configured so as to be blade-shaped. The working section 5 lies in a plane E that encompasses the longitudinal axis 7. The axis in plane E that is perpendicular to the longitudinal axis 7 will be referred to below as the transverse axis 9. The dimensions of the working section in plane E as well as the dimension (length) along the longitudinal axis 7 and also a dimension (width) along the transverse axis 9 are considerably greater than the dimension along the vertical axis 10 (thickness) that runs perpendicular to plane E. The width is preferably two times to four times the thickness.

The working section 5 shown by way of an example has two lengthwise edges 11 that run parallel to the longitudinal axis 7. The distance between the two lengthwise edges 11 defines the width of the working section. The cutting edge 3 connects the two lengthwise edges 11. The cutting edge 3 is on the longitudinal axis 7 and faces away from the striking surface 4. The cutting edge 3 preferably runs in plane E.

The cutting edge 3 runs along the transverse axis 9, that is to say, it is oriented crosswise to the longitudinal axis 7. The cutting edge 3 is saddle-shaped. Along the crosswise direction 12, the cutting edge 3 has a concave curvature in the longitudinal axis 7 and a concave curvature in the vertical axis 10. The concave curvature in the longitudinal axis 7 causes the two lengthwise edges 11 to project in the striking direction 13 beyond the middle of the cutting edge 3 in the striking direction 13. The concave curvature in the vertical axis 10 causes the flat chisel 1 to be thinner in the middle than at the lengthwise edges 11.

Figure 2:
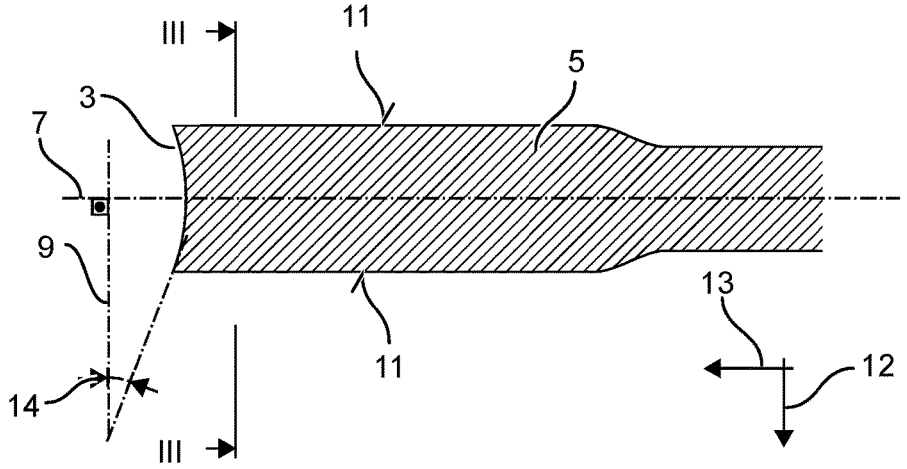
FIG. 2: a longitudinal section through the blade of the flat chisel in plane E.

In the flat chisel 1 shown by way of an example, a (horizontal) inclination 14 of the cutting edge 3 increases relative to the transverse axis 9 continuously from the longitudinal axis 7 to the lengthwise edges 11 (FIG. 2). The maximum inclination 14 is in the range between 10° and 30°. The appertaining (horizontal) curvature radii along the curved area are moderate, for instance, greater than 10 cm. The cutting edge 3 does not have any steps or pronounced notches in the concave area. The cutting edge 3 can be concavely curved over its entire width. As an alternative, especially in the case of wide flat chisels 1, one area is concavely curved around the longitudinal axis 7 while the edge areas of the cutting edge run parallel to the transverse axis 9.

Figure 3:
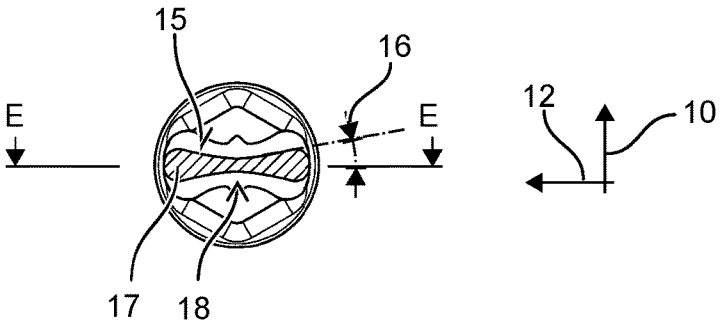
FIG. 3: a cross section through the blade in plane III-III.

One or both of the opposite blade surfaces 15 of the working section 5 are curved concavely (FIG. 3). The distance of the blade surface 15 to plane E is minimal near the longitudinal axis 7 and it increases along the transverse axis 9. Starting from the longitudinal axis 7, the thickness of the working section 5 increases along the transverse axis 9. The thickness preferably decreases continuously in the area around the longitudinal axis 7. A (vertical) maximum inclination 16 of the blade surface 15 relative to the transverse axis 9 is in the range between 10° and 30°. The appertaining (vertical) curvature radius on the longitudinal axis 7 is in the range between 0.5 cm and 2 cm.

The lengthwise edges 11 can be formed by struts 17 that run along the longitudinal axis 7. Between the struts 17, the working section 5 has a channel 18 that runs parallel to the longitudinal axis 7. The thickness of the channel 18 is less than the thickness of the struts 17. The blade surface 15 is concavely curved between the struts 17 correspondingly. The transition from the struts 17 to the channel 18 is preferably smooth, that is to say, without steps. The struts 17 can run all the way to the cutting edge 3; the channel 18 can run all the way to the cutting edge 3.

Figure 4:
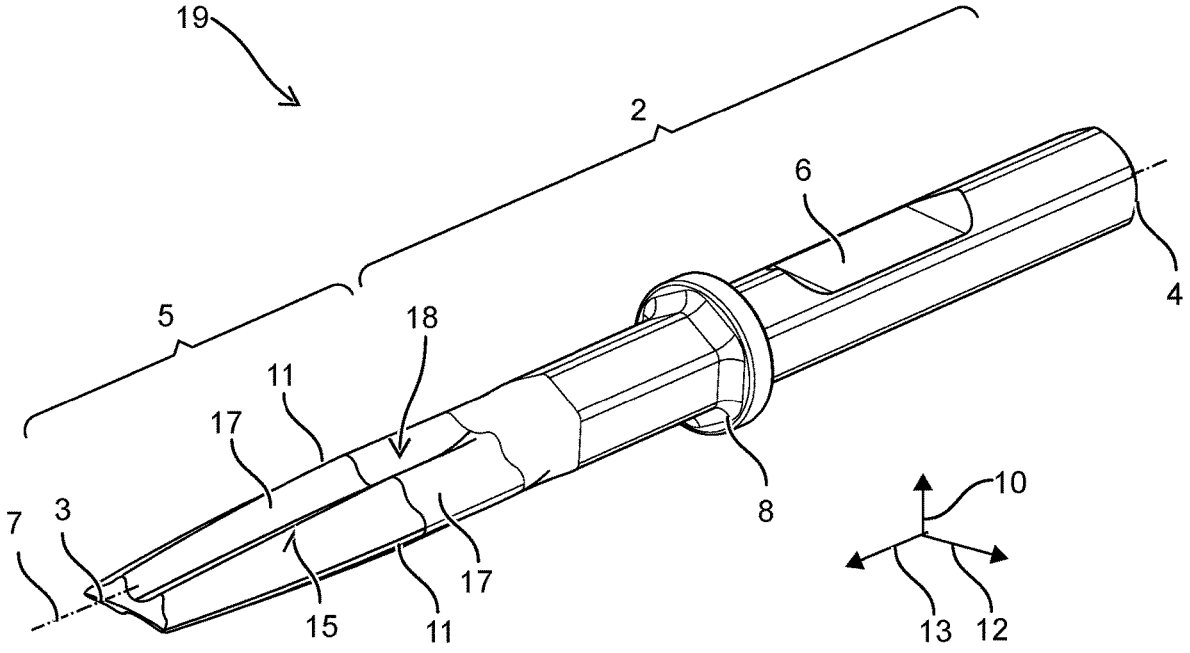
FIG. 4: a flat chisel.

FIG. 4 shows a flat chisel 19. The flat chisel 1 has a shank 2 like the flat chisel 1 described above; reference is hereby made thereto for its description. The flat chisel 19 has a blade-shaped working section 5. The working section 5 forms a concave cutting edge 3. The cutting edge 3 is configured so as to be saddle-shaped.

The working section 5 has precisely two struts 17 that run along the longitudinal axis 7. A channel 18 runs parallel to longitudinal axis 7 between the two struts 17. The blade surface 15 between the two struts 17 is concavely curved continuously along the crosswise direction 12. The distance between the struts 17 and the lengthwise edge 11 is approximately the same as the distance between the struts 17 and the longitudinal axis 17 or the middle of the working section 5. The ratio of the distances is, for example, within the range from 5:6 to 6:5.

Figure 5:
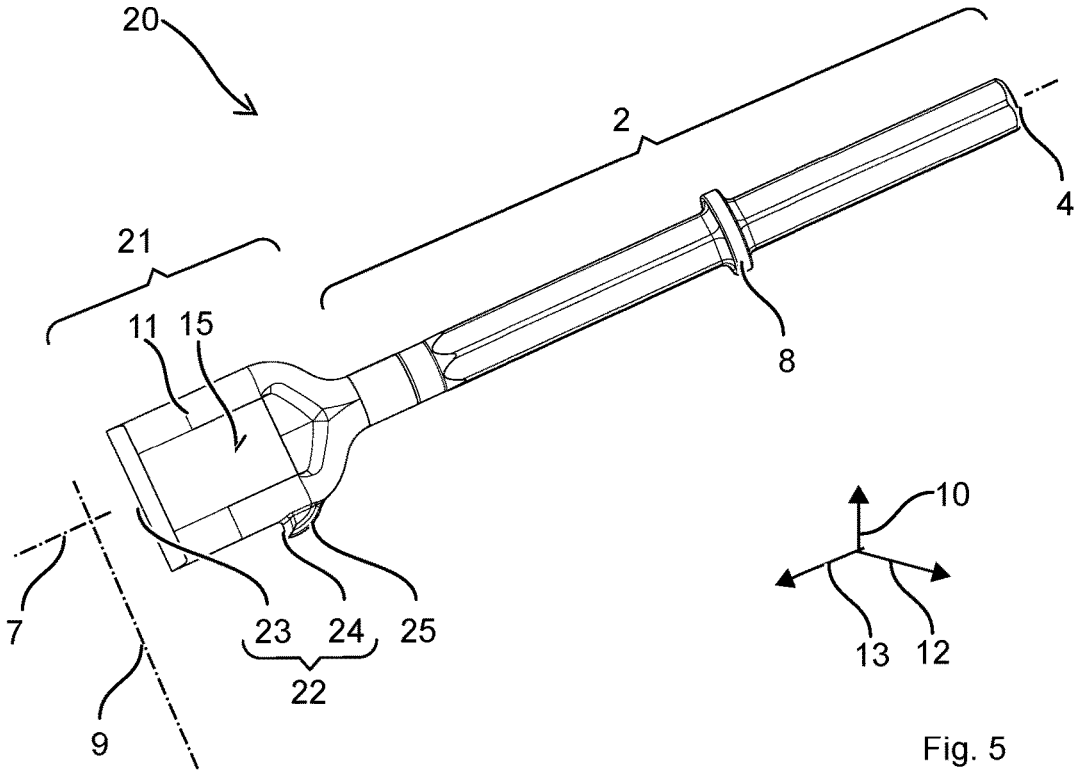
FIG. 5: a flat chisel.
Figure 6:
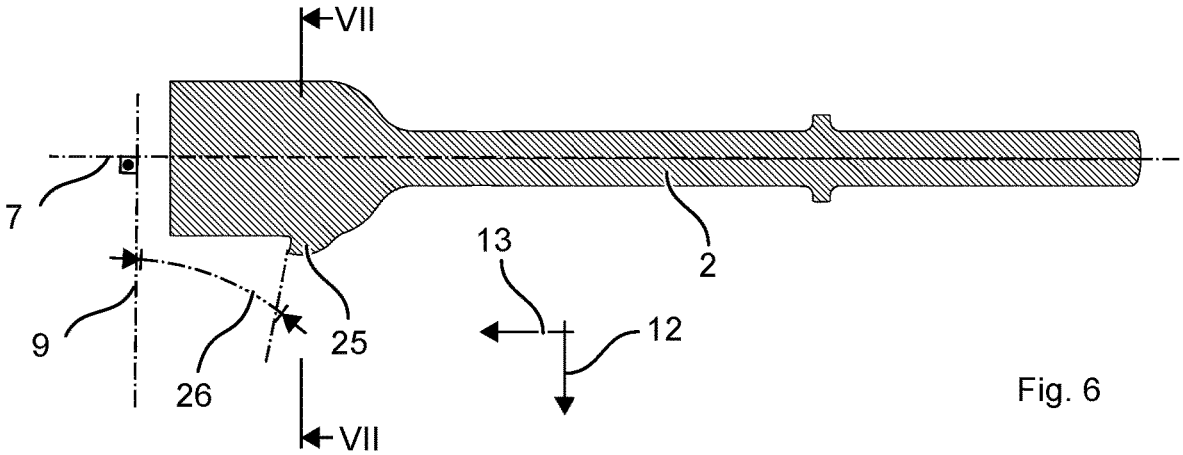
FIG. 6: a longitudinal section through the flat chisel of FIG. 5 in plane VI-VI.
Figure 7:
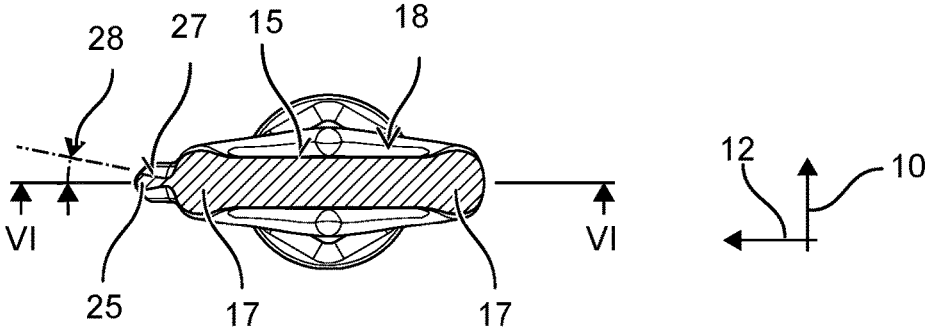
FIG. 7: a cross section through the flat chisel of FIG. 5 in plane VII-VII.

Another flat chisel 20 (FIG. 5) is shown in a longitudinal section in the horizontal plane (FIG. 6) and in a cross section in plane VII-VII (FIG. 7). The flat chisel 20 has a shank 2 that is configured identically or analogously to that of the flat chisel 1. The flat chisel 20 also has a blade-shaped working section 21. The working section 5 has two lengthwise edges 11 that run along the longitudinal axis 7. The opposite blade surfaces 15 extend between both lengthwise edges 11. The thickness of the working section 21 is considerably less than the width and length of the working section 21, analogously to the working section 21 of the flat chisel 1. The blade surfaces 15 can be flat or curved.

The flat chisel 20 has a two-part cutting edge 22 consisting of a main blade 23 and a secondary blade 24. The main blade 23 runs along the transverse axis 9. Preferably, the main blade 23 is arranged symmetrically to the longitudinal axis 7. In the embodiment shown by way of an example, the main blade 23 is configured so as to be rectilinear and perpendicular to the longitudinal axis 7. The main blade 23 can be concavely curved, analogously to the cutting edge 3.

The secondary blade 24 is arranged along the longitudinal axis 7 so as to be offset relative to the main blade 23. The secondary blade 24 shown by way of an example is formed by a tooth 25 that projects from the lengthwise edge 11 in the transverse axis 9. The secondary blade 24 is inclined relative to the transverse axis 9 by an angle of inclination. The inclination 14 can be equal to the maximum inclination 14 in the first embodiment. The secondary blade 24 is inclined counter to the striking direction 13 in the direction of the lengthwise edge 11. The secondary blade 24 shown by way of an example is concavely curved. As an alternative, the secondary blade 24 can be configured so as to be rectilinear. The lengthwise edge 11 and the secondary blade 24 form a concave area in which rebar can be installed. The tooth 25 tapers towards the lengthwise edge 11. The side surfaces 27 of the tooth 25 are inclined relative to the horizontal plane E by an angle of inclination 28.

Figure 8:
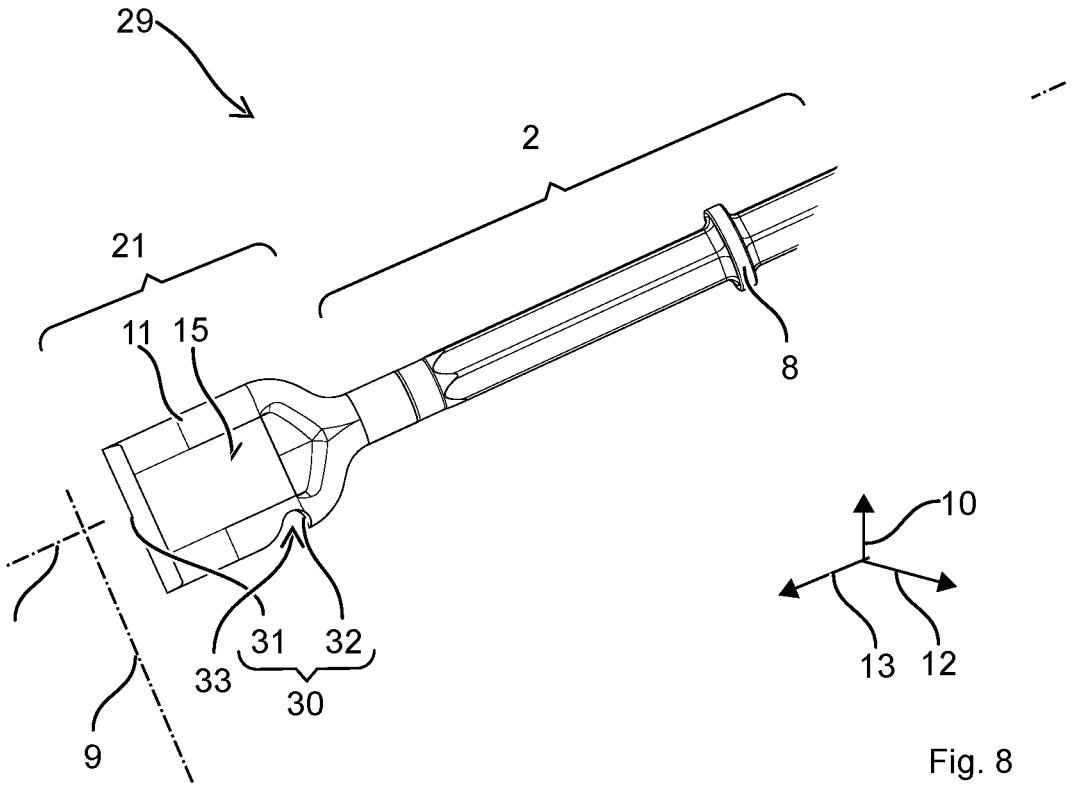
FIG. 8: a flat chisel.
Figure 9:
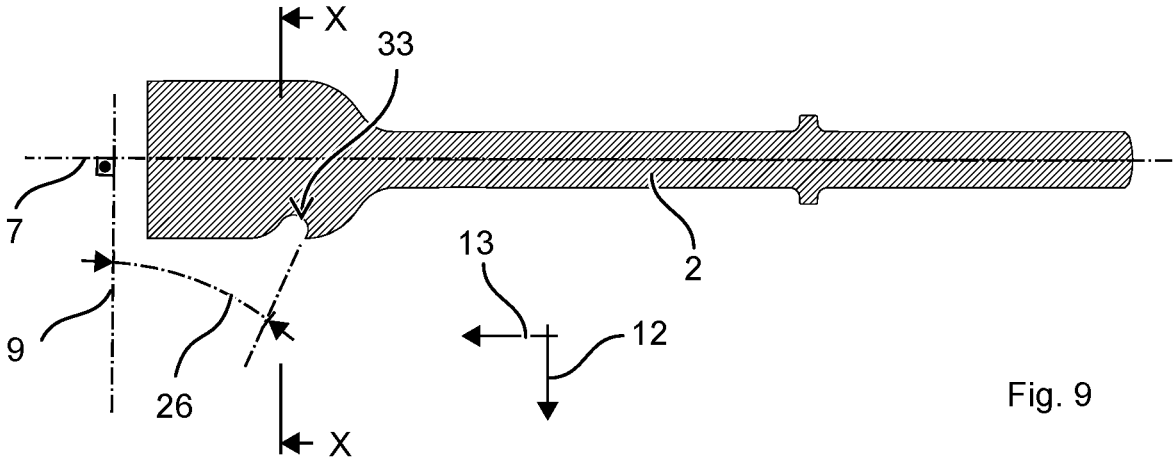
FIG. 9 a longitudinal section through the flat chisel of FIG. 8 in plane IX-IX.
Figure 10:
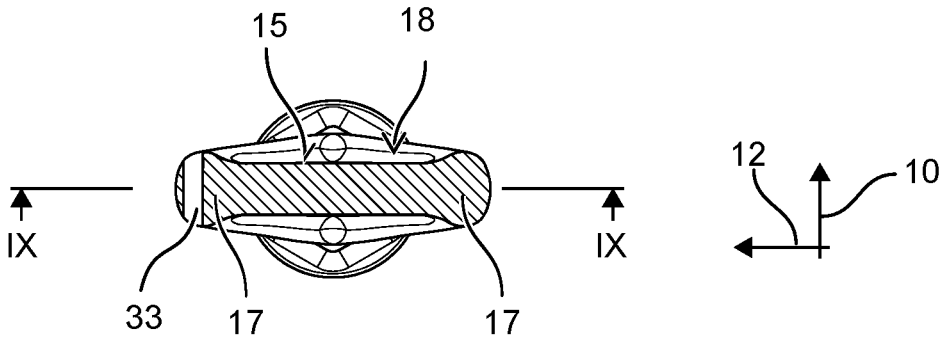
FIG. 10 a cross section through the flat chisel of FIG. 8 in plane X-X.

Another flat chisel 29 (FIG. 8) is shown in a longitudinal section (FIG. 9) and in a cross section in plane VIII-VIII (FIG. 10). The flat chisel 29 has a shank 2 and a working section 21 that are configured identically or analogously to those on the flat chisel 20.

The flat chisel 29 has a two-part cutting edge 30 consisting of a main blade 31 and a secondary blade 32. The main blade 31 runs along the transverse axis 9. Preferably, the main blade 31 is arranged symmetrically to the longitudinal axis 7. In the embodiment shown by way of an example, the main blade 31 is configured so as to be rectilinear and perpendicular to the longitudinal axis 7. The main blade 31 can be concavely curved, analogously to the cutting edge 3.

The secondary blade 32 is arranged along the longitudinal axis 7 so as to be offset relative to the main blade 31. The secondary blade 32 shown by way of an example is formed by a recess 33 in the lengthwise edge 11. The (hollow) dimensions of the recess 33 correspond approximately to the cross section of a typical rebar. The recess 33 can especially be configured so as to be in the form of a circular segment. The curvature radius is in the order of magnitude of the radius of a typical rebar. The secondary blade 32 is formed by the edge of the recess 33 that faces in the striking direction 13. The secondary blade 32 is curved concavely, that is to say, circularly. The point of the cutting edge 3 that is furthest recessed relative to the striking direction 13 is inside the recess 33, that is to say, it is offset relative to the lengthwise edge 11 along the transverse axis 9. The cutting edge 3 rises in the striking direction 13 from the point towards the lengthwise edge 11. Starting from the lengthwise edge 11, the secondary blade 32 is inclined counter to the striking direction 13 by the angle of inclination 26. The thickness of the secondary blade 32 changes along the secondary blade 32. Preferably, the thickness is at its smallest value at the furthest recessed point.

What is claimed is:

1. A flat chisel to process mineral materials, the flat chisel having a central longitudinal axis and a transverse axis perpendicular to the longitudinal axis, the transverse axis defining a transverse direction, the flat chisel comprising:

a shank arranged along the central longitudinal axis and having a striking surface perpendicular to the longitudinal axis; and a blade-shaped working section with a cutting edge running in the transverse direction, the cutting edge being configured to be saddle-shaped, the cutting edge having a first concave curvature in a first plane formed between the longitudinal axis and the transverse axis, and the cutting edge has a second concave curvature in a second plane perpendicular to the central longitudinal axis and parallel to a normal axis perpendicular to the first plane.

2. The flat chisel as recited in claim 1 wherein the first concave curvature and the second concave curvature coincide along the transverse axis.

3. The flat chisel as recited in claim 1 wherein the saddle-shaped cutting edge is arranged symmetrically relative to the central longitudinal axis.

4. The flat chisel as recited in claim 1 wherein the first curvature is bisected by and the second curvature is spaced from the central longitudinal axis.

5. The flat chisel as recited in claim 1 wherein the saddle-shaped cutting edge is arranged along the transverse axis so as to be offset relative to the central longitudinal axis.

6. The flat chisel as recited in claim 5 wherein the cutting edge has a main blade and a saddle-shaped secondary blade, the saddle-shaped secondary blade being formed on the blade-shaped working section by a tooth offset relative to the main blade along the central longitudinal axis.

7. The flat chisel as recited in claim 5 wherein the cutting edge has a main blade and a saddle-shaped secondary blade, the saddle-shaped secondary blade being formed in the blade-shaped working section by a recess offset relative to the main blade along the central longitudinal axis.

8. The flat chisel as recited in claim 1 wherein the first curvature is arranged along the transverse axis so as to be offset relative to the central longitudinal axis.

9. The flat chisel as recited in claim 1 further comprising struts running along the central longitudinal axis and defining a channel between the struts, the second concave curvature extending between the struts.

10. The flat chisel as recited in claim 1 wherein an inclination of the cutting edge in the first plane increases relative to the transverse axis continuously from the central longitudinal axis.

11. The flat chisel as recited in claim 10 wherein a maximum of the inclination in the first plane is in a range between 10° and 30°.

12. The flat chisel as recited in claim 1 wherein a maximum inclination in the second plane of the second concave curvature relative to the transverse axis is in the range between 10° and 30°.

13. The flat chisel as recited in claim 12 wherein a curvature radius of the second concave curvature is in a range between 0.5 cm and 2 cm.

14. The flat chisel as recited in claim 1 wherein the cutting edge is concavely curved over an entire width of the cutting edge along the transverse axis.

* * * * *